US007762029B2

(12) United States Patent
Hayes et al.

(10) Patent No.: US 7,762,029 B2
(45) Date of Patent: Jul. 27, 2010

(54) ANCHOR FOR POST TENSION CONCRETE REINFORCING SYSTEMS

(75) Inventors: Norris O. Hayes, Stafford, TX (US); Randy Draginis, Terrell, TX (US)

(73) Assignee: Hayes Specialty Machining, Ltd., Sugar Land, TX (US)

( * ) Notice: Subject to any disclaimer, the term of this patent is extended or adjusted under 35 U.S.C. 154(b) by 187 days.

(21) Appl. No.: 10/984,575

(22) Filed: Nov. 9, 2004

(65) Prior Publication Data

US 2006/0096196 A1 May 11, 2006

(51) Int. Cl.
*E04C 5/08* (2006.01)

(52) U.S. Cl. ..... 52/223.13; 52/223.6; 52/223.14; 405/259.1

(58) Field of Classification Search ..... 52/698, 52/223.13, 371, 373, 374.1, 223.14, 223.1, 52/223.4, 223.5, 223.2, 223.3, 223.6–223.12; 403/371, 373, 374, 367, 374.2, 374.1; 405/256.1–259.6
See application file for complete search history.

(56) References Cited

U.S. PATENT DOCUMENTS 3,703,748 A * 11/1972 Kelly ..... 403/368
3,912,406 A * 10/1975 McGrath ..... 403/19
4,616,458 A * 10/1986 Davis et al. ..... 52/223.13
5,072,558 A * 12/1991 Sorkin et al. ..... 52/223.13
5,141,356 A * 8/1992 Chaize ..... 403/368
5,271,199 A * 12/1993 Northern ..... 52/223.13
6,631,596 B1 * 10/2003 Sorkin ..... 52/223.13
6,684,585 B2 * 2/2004 Campbell ..... 52/223.13

OTHER PUBLICATIONS

Alan H. Stubbs, Friction Anchors for Prestressing Tendons and "The Atlas System" (publisher unknown) Oct. 1965.
Precision Sure Lock, drawing of part of repair chuck (publication date unknown).

* cited by examiner

*Primary Examiner*—Richard E Chilcot, Jr.
*Assistant Examiner*—William V Gilbert
(74) *Attorney, Agent, or Firm*—Richard A. Fagin

(57) ABSTRACT

An anchor for a post tension reinforcement is disclosed. The anchor includes an anchor base having at least one wedge receiving bore therein. The wedge receiving bore is tapered in diameter at a single selected taper angle. An axial length of the wedge receiving bore is selected so that a minimum internal diameter of the wedge receiving bore is at least as large as an external diameter of a sheath on a reinforcing tendon. In another aspect, the wedge receiving bore is positioned in the anchor so that its longitudinal center is approximately collocated with a load bearing basal surface of the anchor.

38 Claims, 5 Drawing Sheets

ANCHOR FOR POST TENSION CONCRETE REINFORCING SYSTEMS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The invention relates generally to the field of post tension concrete reinforcing devices and systems. More particularly, the invention relates to structures for anchors used in such concrete reinforcing systems.

2. Background Art

Structural concrete is capable of carrying substantial compressive load, however, concrete is unable to carry significant tensile loads. It becomes necessary, therefore, to add steel bars, called reinforcements, to concrete, thus allowing the concrete to carry the compressive forces and the steel to carry the tensile forces on a concrete structure.

The basic principle of concrete reinforcement is simple. In pre-stressing, which is one of two basic types of reinforcement, reinforcing rods of high tensile strength wires are stretched a certain amount and then high-strength concrete is placed around the reinforcing rods. When the concrete has set, it holds the steel in a tight grip, preventing slippage or sagging. The other type of reinforcement, called post-tensioning, follows the same general principle, but the reinforcing rods (called "tendons") are held loosely in place while the concrete is placed around them. The tendons are then stretched by hydraulic jacks and are securely anchored into place. Prestressing is typically performed within individual concrete members at the place of manufacture. Post-tensioning is generally performed as part of the structure on the construction site.

A typical tendon tensioning anchor system for post-tensioning operations, includes a pair of anchors for anchoring the two ends of the tendons suspended therebetween. In the course of installing the tendon and anchors in a concrete structure, a hydraulic jack or the like is releasably attached to one of the exposed ends of the tendon for applying a predetermined amount of tension to the tendon. When the desired amount of tension is applied to the tendon, wedges, threaded nuts, or the like, are used to capture the tendon and, as the jack is removed from the tendon, to prevent its relaxation and hold it in its stressed condition, thus applying tensile force on the tension to the anchors.

Metallic components, such as tendons, disposed within concrete structures may be come exposed to many corrosive elements, such as de-icing chemicals, sea water, brackish water, or spray from these sources, as well as salt water. If such exposure occurs, and the exposed portions of the anchor and tendon suffer corrosion, then the anchor may become weakened due to this corrosion. The deterioration of the anchor and tendon can cause the tendons to slip, thereby losing the compressive effects on the structure, or the anchor can fracture. In addition, the large volume of by-products from the corrosive reaction is often sufficient to fracture the surrounding structure. These elements and problems can be sufficient so as to cause a premature failure of the post-tensioning system and a deterioration of the structure.

A typical post-tension assembly, therefore, includes a liquid tight covering or sheathing on its exterior surface. Some anchors are encapsulated in a moisture proof material such as plastic. An example of such an encapsulated post tension reinforcing system is described in U.S. Pat. No. 5,072,558 issued to Sorkin et al. The system disclosed in the '558 patent includes a tendon having an exposed end protruding from a sheath. The exposed end of the tendon is typically fitted through an extension tube. The extension tube has a diameter slightly larger than sheath, such that one end of the extension tube may overlie the sheath. The opposite end of the extension tube fits over, and communicates with, a rear tubular portion of an anchor. The rear tubular member includes an aperture which communicates with a frontal aperture. The frontal aperture defines a cavity or bore in which anchoring wedges are received.

As known in the art, the tendon is disposed through the extension tube and through the anchor wedge receiving bore. The end of the extension tube is sealed to the outer surface of the sheath. After the tendon extends through the frontal aperture, and assuming the far end of the tendon is fixed in place, tension is applied to the tendon, typically by use of a hydraulic jack. While applying this tension, wedges are forced in place on both sides of tendon within the wedge receiving bore. Once in place, teeth on the wedges operate to lock the tendon in a fixed position with respect to the anchor. Thereafter, the tension supplied by the hydraulic device is released and the excess tendon extending outward from the anchor is cut by a torch or other known device. The wedges thereafter prevent the tendon from releasing its tension and retracting inward with respect to the anchor. Moreover, the tension remaining on the tendon provides additional tensile strength across the concrete structure.

It has been determined that the wedge receiving cavity in the anchor body known in the art crated many problems. The wedge receiving bore in the anchor body is typically of a constantly diminishing diameter extending from a forward end of the anchor body to a rearward end of the anchor body. This constantly diminishing diameter is formed during the casting of the anchor body. However, the narrow diameter end of the wedge receiving bore creates problems with the installation of sheathed tendons. When the anchor body is used in the formation of intermediate anchorages, for example, it is often necessary to move the anchor body over a very long length of sheathed tendon. If there is insufficient clearance between the narrow diameter end of the cavity and the outer diameter of the sheathed portion of the tendon, nicks, abrasions, and cuts can occur in the corrosion-resistant sheathing. As such, the integrity of the anchorage system is impaired. Furthermore, there are circumstances where the sheathing diameter may exceed expected tolerances and will prevent the anchor body from easily sliding along the length of the tendon so as to assume its position as an intermediate anchorage. Additionally, in recent years, there has been a tendency to increase the thickness of the sheathing so as to facilitate greater protection of the tendon from corrosive elements. It should be noted that similar problems can occur at a "live end" terminal anchor, the live end being the end of the tendon that is pulled or stretched to apply tension to the tendon.

An easy solution to the foregoing problems would be to expand the diameter of the wedge receiving bore so as to avoid the aforementioned problems. However, if the overall diameter of the bore is expanded, then conventional (standard size and taper) wedges cannot be used. Other problems may occur if larger or non-standard size wedges or if irregular wedges are used. If the wedge receiving bore were enlarged, then the wedge components would have to be replaced in all such post-tension anchor systems.

It is also known in the art to drill out or ream the narrow diameter end of the wedge receiving bore so as to produce a portion of generally constant diameter. However, drilling and reaming have some limitations. First, drilling or reaming can be very expensive in comparison with the casting of the anchors. Furthermore, drilling or reaming of a constant diameter portion in the anchor body can create burrs and deformations which could potentially cut the sheathing of the tendon and cause adverse corrosion-protection results. Finally, drilling or reaming the narrow portion of the wedge receiving bore can intrude into the wedge-contact area so as to cause uneven and irregular contact between the wedges and the wall of the cavity. Such irregular contact may weaken the anchoring system.

One solution to the foregoing is described in U.S. Pat. No. 6,017,165 issued to Sorkin. An anchor body disclosed in the '165 patent includes an internal wedge-receiving cavity. The cavity has a first portion of constantly diminishing diameter extending inwardly from one end of the anchor body. The first portion has an angle of taper with respect to a center line of the cavity. The cavity has a second portion extending inwardly from an opposite end of the anchor body. The first portion and the second portion are coaxial and communicate with each other. The second portion has an angle of taper which is less than the first portion. The first and second portions are cast with the anchor body. Other patents issued to Sorkin disclose variations of the same general concept, namely that the wedge receiving cavity is divided into a first portion and a second portion, wherein the second portion has a different taper angle than the first portion, such that a minimum internal diameter of the wedge receiving bore is at least large enough to enable free passage of a sheathed tendon therethrough.

One limitation to the anchors disclosed in the various Sorkin patents is the cost of casting the anchor to have more than one taper angle in the wedge receiving bore. It has also been determined that prior art wedges may be more massive, and have more uneven distribution of axial stresses to the anchor base or plate than may be considered optimal. Accordingly, there is a need for an anchor for post tension concrete reinforcing systems which more evenly distributes stress to the anchor base, and which is less expensive to manufacture.

SUMMARY OF THE INVENTION

One aspect of the invention is an anchor for a post tension reinforcement system. The anchor includes an anchor base having at least one wedge receiving bore therein. The wedge receiving bore is tapered in diameter at a single selected taper angle. An axial length of the wedge receiving bore is selected so that a minimum internal diameter of the wedge receiving bore is at least as large as an external diameter of a sheath on a reinforcing tendon.

Another aspect of the invention is an anchor for a post tension reinforcement system. An anchor according to this aspect of the invention include an anchor base having at least one wedge receiving bore therein. The wedge receiving bore is positioned in the anchor base such that its longitudinal center is approximately collocated with a basal surface of the anchor base.

Yet another aspect of the invention is an anchor for a post tension reinforcement system. An anchor according to this aspect of the invention includes an anchor base having a specific weight of at most about 0.1 pounds per square inch. Specific weight represents the weight of the anchor base with respect to its load-bearing surface area.

Other aspects and advantages of the invention will be apparent from the following description and the appended claims.

DETAILED DESCRIPTION

Figure 1:
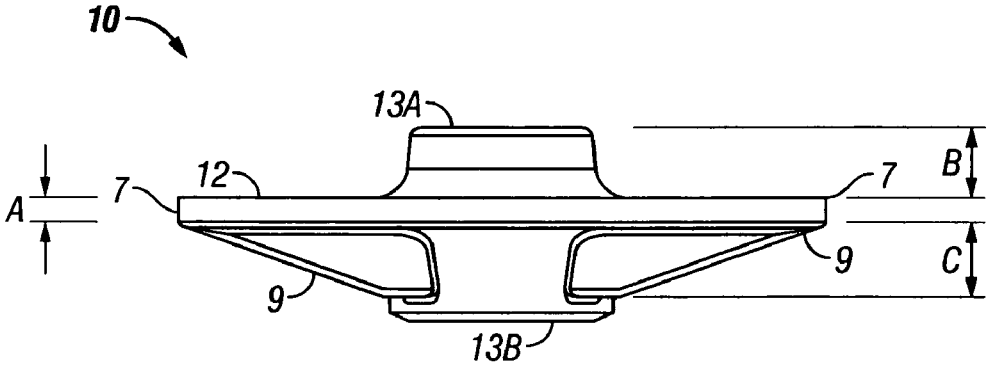
FIG. 1 (Prior Art)
FIG. 1 shows a side view of a prior art post tension anchor.

To better understand post tension anchors according to the invention, it is useful to examine specific differences between various embodiments of an anchor according to the invention and prior art post tension anchors. A typical prior art post tension anchor is shown in side view FIG. 1. The anchor 10 includes an anchor body typically cast from ductile iron or similar cast metals. The anchor 10 includes a cast metal structure 7 having a load-bearing basal surface 12. The load-bearing basal surface 12 is adapted to contact a concrete structure (not shown) for post tension reinforcement according to methods well known in the art. The basal surface 12 is where tension from the tendon (not shown) is actually transferred to the concrete structure (not shown). The anchor 10 also includes a plurality of reinforcing ribs 9 which extend substantially from the outer edges of the anchor body to a generally central portion of the anchor body structure which defines a wedge receiving bore (shown at 14 in FIG. 3). The wedge receiving bore (14 in FIG. 3) has first end 13A and a second end 13B that will be further explained with reference to FIG. 3. A typical arrangement of the reinforcing ribs 9 can be better seen in FIG. 2.

Still referring to FIG. 1, a dimension indicated by A represents the approximate thickness of the metal structure 7. A dimension indicated by B represents the distance from the basal surface 12 to a first end 13A of the wedge receiving bore (14 in FIG. 3). Dimension C represents the distance between the upper surface of the metal structure (forming the basal surface 12) and the second end 13B of the wedge receiving bore 14. Typical dimensions as will be explained below are for a typical industry standard anchor used with a 0.500 inch nominal diameter reinforcing tendon.

Figure 3:
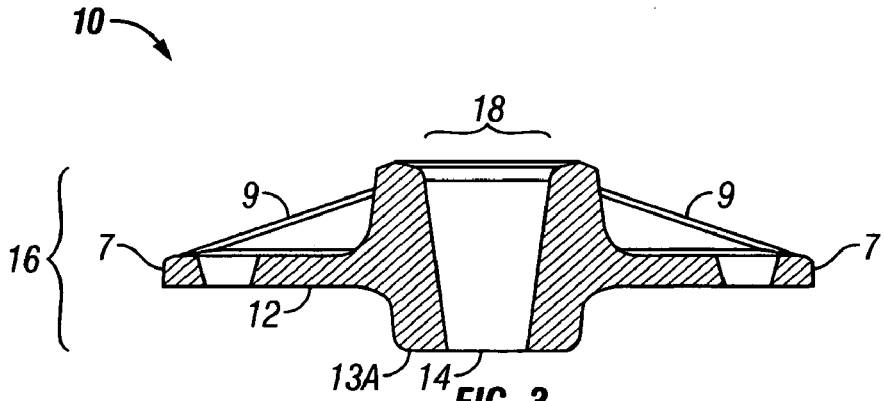
FIG. 3 (Prior Art)
FIG. 3 shows a cross-section of the anchor of FIG. 1.

FIG. 3 is a cross section through the center line of the anchor 10 in the plane of the long transverse dimension of the anchor 10. FIG. 3 shows the wedge receiving bore 14 as being tapered from the second end 13B to the first end 13A such that the diameter of the receiving bore 14 becomes smaller at a single taper angle along the axial length of the wedge receiving bore 14. Typically the taper angle of the wedge receiving bore 14 is about seven degrees.

Figure 2:
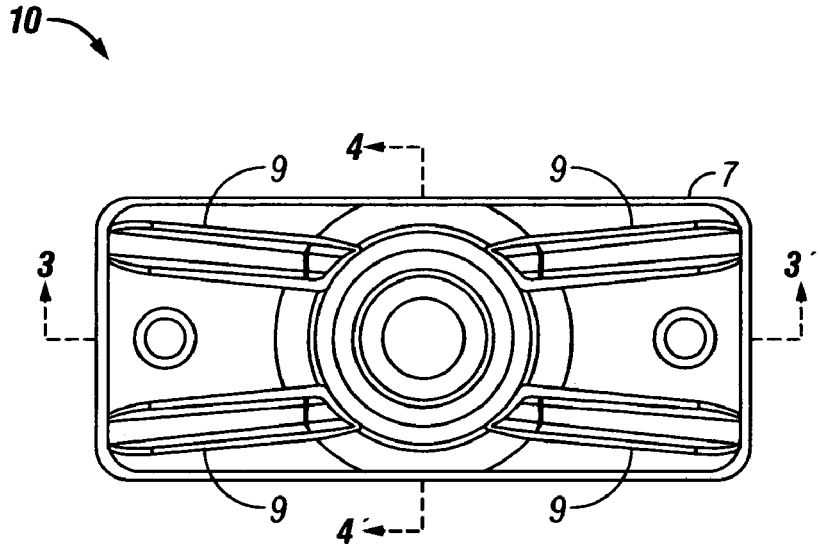
FIG. 2 (Prior Art)
FIG. 2 shows a top view of the anchor of FIG. 1.

The following example dimensions are for industry standard anchors used with 0.500 inch nominal outer diameter (OD) tendons (the OD being defined as without a sheath on the tendon). For anchors used with other size tendons, the dimensions shown in the example of FIGS. 1-3 are typically directly, linearly scaled with respect to the nominal diameter of the tendon. Typical dimensions for anchors used with 0.500 inch OD tendons include a maximum nominal internal diameter of the wedge receiving bore 14 of about 1.00 inch at the second end 13B (the typical actual diameter of the bore at the point of contact with anchor wedges inside the bore 14 is about 0.97 inch), a minimum internal diameter of the wedge receiving bore 14 of about 0.63 inches at the first end 13A, and an overall axial length of the wedge receiving bore 14 of about 1.50 inches.

Figure 4:
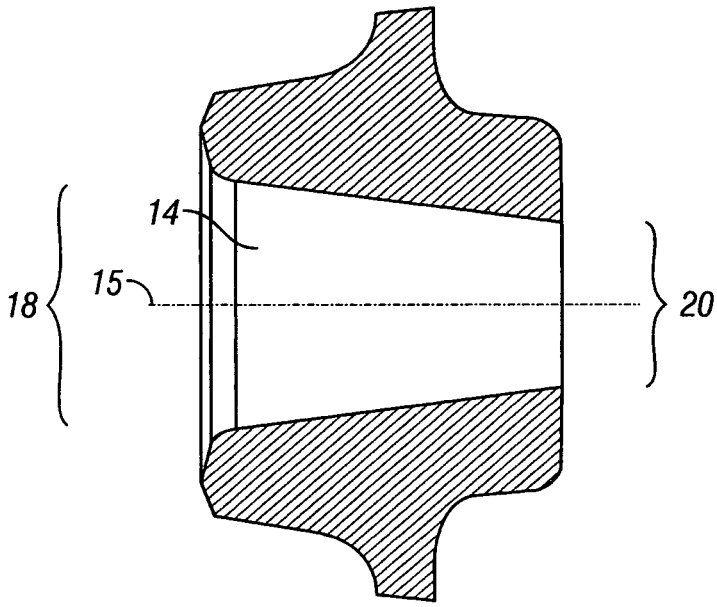
FIG. 4 (Prior Art)
FIG. 4 shows a cross section orthogonal to the cross section of FIG. 3.

Returning to FIG. 1, a typical thickness (dimension A) of the metal structure 7 (forming basal surface 12) is about 0.23 inches, and the distance from the basal surface 12 to the first end 13A is about 0.53 inches. A cross sectional view along the short transverse dimension (orthogonal to the view in FIG. 3) of the prior art anchor is shown in FIG. 4, where the maximum internal diameter 18 of the wedge receiving bore 14 is about 1.00 inches, and the minimum internal diameter 20 of the wedge receiving bore 14 is about 0.63 inches.

Dimension C also represents the approximate height of the ribs 9. In the example of FIGS. 1-4, the dimension C is about 0.54 inches. As will be explained below with reference to FIGS. 5-8, it has been determined that the rib height can be reduced without substantially weakening the anchor.

As is known in the art, a 0.500 inch tendon that includes a sheath will have a nominal external diameter of about 0.65 inches when using a 0.060 inch (60 mil) thick plastic sheath, and including any lubricant or other protective material between the tendon and the sheath. As a result, the minimum internal diameter of the wedge receiving bore 14 of the prior art anchor 10 is typically too small to allow free passage of a typical sheathed tendon therethrough.

Enlargement techniques for the minimum internal diameter of the wedge receiving bore known in the art, as explained in the Background section herein, include reaming or drilling near the first end of the wedge receiving bore 14. Other enlargement techniques include casting the wedge receiving bore to include a second taper angle different from the principal taper angle of the wedge receiving bore so as to provide a minimum internal diameter of the wedge receiving bore large enough to freely admit a sheathed tendon.

Having explained prior art anchor structures, anchors according to the invention will now be explained with reference to FIGS. 5-8. First referring to FIG. 5, an anchor 10A according to the invention includes a cast anchor body having a laterally extending metal structure 7A which defines a basal surface 12A thereon and a wedge receiving bore 14A disposed approximately in the center of the anchor body. The wedge receiving bore 14A is tapered in decreasing internal diameter from the second end 13D to the first end 13C. Notably, the wedge receiving bore 14A in the present embodiment can include a single taper angle of about seven degrees, just as is the case for prior art anchors. Similarly, the maximum nominal internal diameter of the wedge receiving bore 14A is about 1.00 inches at the second end 13D, just as for prior art wedge receiving bores. Thus, the anchor 10A of the invention can use conventional wedges and tendons. In the present embodiment, the single taper in the wedge receiving bore 14A extends substantially continuously from one end 13C of the bore 14A to the other end 13D. As will be further explained, certain dimensions of the bore 14A are selected such that a preferred minimum internal diameter is maintained in the bore 14A, without the need to ream or drill the small diameter end of the bore. Those skilled in the art will appreciate that a certain amount of the small diameter end of the bore 14A may need to be machined in some manner to remove casting flash as a byproduct of the casting process, but such flash removal does not materially affect the overall structure of the bore 14A as will be explained below. It should also be understood that an anchor made according to the invention is not limited to being used with sheathed tendons, and such an anchor may be used on the live end, the fixed end or at intermediate positions in any anchoring application.

The thickness of the metal structure 7A (forming the basal surface 12A) is shown at dimension AA, and may be 0.21 inches or less. It has been determined that the thickness of the metal structure 7A may be reduced as compared to the prior art structure (7 in FIG. 1) when other dimensions are changed according to the invention, without substantially reducing the strength of the anchor 10A. An advantage offered by reducing the thickness of the metal structure 7A is reduced overall weight of the anchor 10A.

The dimension from the second end 13D of the wedge receiving bore 14A to the metal structure 7A in the present embodiment is reduced to about 0.31 inches (as compared with 0.54 inches in the prior art anchor).

The anchor 10A according to the present embodiment includes one or more reinforcing ribs 9A extending laterally outward from the structure forming the wedge receiving bore 14A. The reduction in the distance between the second end 13D and the upper surface of the metal structure 7A also can provide for a reduction in the rib 9A height. Prior art ribs (9 in FIG. 1) had a ratio of rib height to maximum wedge receiving bore diameter of about 0.5-0.6. In an anchor according to the invention, the corresponding ratio may be reduced to at most about 0.35 without substantially weakening the anchor 10A. Another aspect of the ribs 9A, which is their termination laterally outward from the wedge receiving bore 14A will be explained below in more detail.

The distance from the basal surface 12A to the first end 13C of the wedge receiving bore 14A in the present embodiment is about 0.53 inches, essentially unchanged from the prior art anchor (see FIG. 1). The result of these dimensions is that the overall axial length 16A of the wedge receiving bore in the present embodiment is about 1.30 inches, as compared with 1.50 inches in the prior art (see FIG. 1). The foregoing dimensions, as previously explained, may be essentially linearly scaled for anchors used with other size tendons. Accordingly, an anchor made according to one aspect of the invention has a wedge receiving bore axial length of at most about 1.3 times the maximum internal diameter of the wedge receiving bore, and about 2 times the minimum internal diameter of the wedge receiving bore.

As a result of having the same maximum internal diameter 18A, the same taper angle and the foregoing shorter overall axial length 16A of the wedge receiving bore 14A as compared to corresponding dimensions in the typical prior art anchor, the minimum internal diameter of the wedge receiving bore 14A in the present embodiment is about 0.68 inches, allowing free passage of a typical sheathed tendon. Another result of the selected axial length of the bore 14A and the resulting longitudinal positioning of the bore 14A with respect to the basal surface 12A is that the wedge receiving bore 14A is located such that its longitudinal (or axial) center is approximately collocated with the basal surface 12A. It is believed that such longitudinal placement of the bore 14A with respect to the basal surface 12A may improve the overall strength of the anchor 10A. In other embodiments, the wedge receiving bore may be formed such as disclosed in U.S. Pat.

No. 6,017,165 issued to Sorkin, wherein the bore has a first taper and a second taper such that a minimum internal diameter of the bore is at least enough to enable passage of a sheathed tendon therethrough. The wedge receiving bore in such embodiments can still be located such that its longitudinal center is approximately collocated with the basal surface 12A, thus improving the overall strength of the anchor.

Another feature of an anchor made according to the embodiment shown in FIGS. 5-8, as suggested above, is that the reinforcing ribs 9A may be formed so that their lateral termination outward from the wedge receiving bore 14A is at a selected distance inward from a laterally outward edge of the metal structure 7A. Referring once again to FIG. 6, a laterally outermost edge 9B of the ribs 9A is shown at a position about 0.25 inches from the outer edge 7B of the metal structure 7A. The length of the metal structure 7A (long transverse dimension) is about 5 inches in the example embodiment of FIG. 6. It has been determined through finite element analysis that such a lateral extent dimension for the ribs 9A can provide adequate support strength to the anchor, while providing substantial savings in weight of metal to the metal structure 7A. In the present embodiment, the ribs 9A terminate at a distance corresponding to about 0.05 times the long transverse dimension of basal surface 12A. It is believed that terminating the ribs 9A at a distance in a range of about 0.03 to 0.1 times the long transverse dimension of the basal surface 12A will provide sufficient strength while providing significant weight savings. In other embodiments, the basal surface may be circular or elliptical in plan view. In such embodiments, the ratio defined above for the termination position of the ribs is determined with respect to whatever is the longest transverse dimension in the particular embodiment of the anchor.

Figure 5:
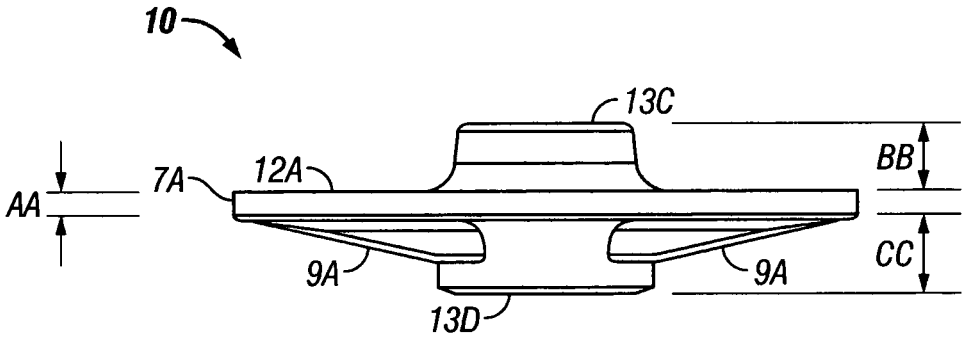
FIG. 5 shows a side view of one embodiment of an anchor according to the invention.

It has also been determined that various configurations of an anchor according to the invention may result in a substantial reduction in the specific weight of the anchor, which is defined as the ratio of the weight of the anchor with respect to the load bearing surface area of the basal surface (12A in FIG. 5). For example, anchors made according to the prior art, such as explained above with reference to FIGS. 1-4, and sized for a nominal 0.500 inch diameter tendon, have an average weight of about 1.2 pounds or more, while having a load bearing area of about 10.8 square inches. This provides a specific weight of about 0.11 pounds per square inch. It will be appreciated by those skilled in the art that the load bearing area of the basal surface generally excludes portions of the anchor surrounding the wedge receiving bore, such as at the second end.

Figure 6:
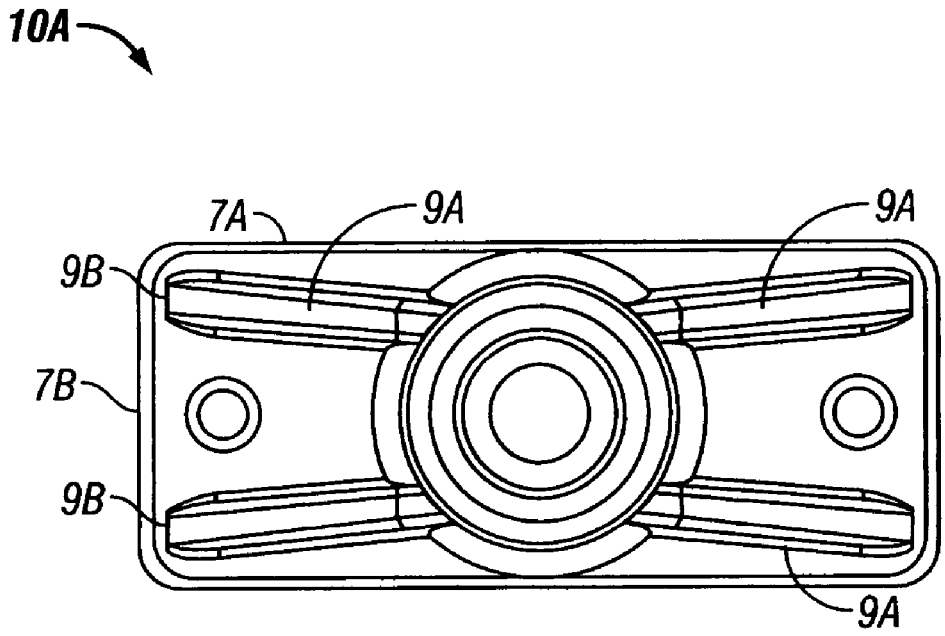
FIG. 6 shows a top view of the anchor of FIG. 5.
Figure 7:
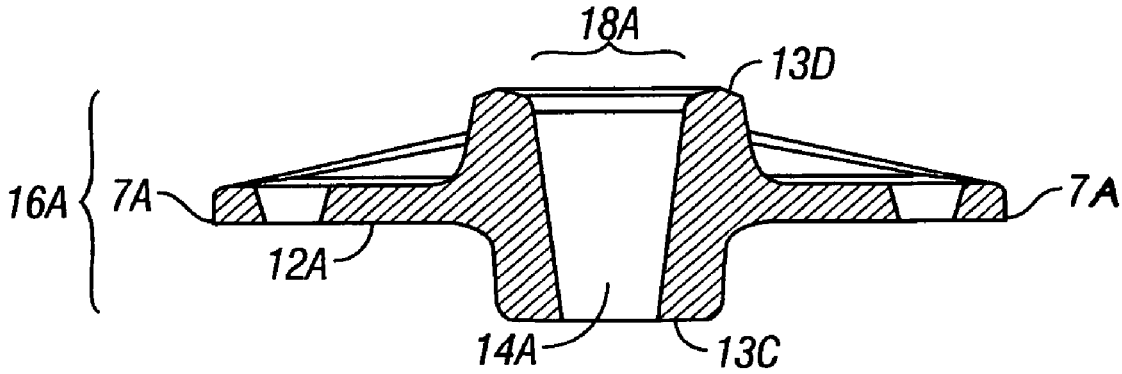
FIG. 7 shows a cross-section of the anchor of FIG. 5.
Figure 8:
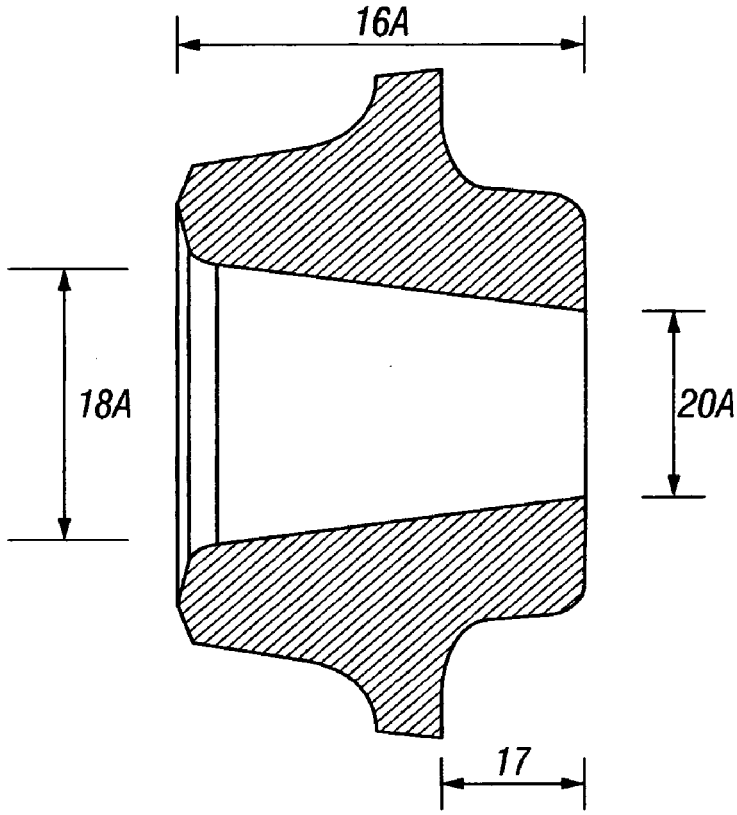
FIG. 8 shows a cross section orthogonal to the cross section of FIG. 7.

Anchors made according to one aspect of the invention weigh at most about 1.1 pounds, particularly those which are made according to the dimensions explained with reference to FIGS. 5 through 7. Such anchors have essentially the same basal surface area and therefore have a specific weight of at most about 0.1 pounds per square inch. Thus, anchors according to the invention may provide substantial savings in cost of the metal used to form the metal structure, while providing at least the same supporting strength as anchors made according to the prior art.

It will be appreciated by those skilled in the art that the foregoing specific weight limitation of about 0.10 pounds per square inch is specifically for industry standard dimension anchors used with 0.500 inch nominal OD tendons. For anchors used with different nominal OD tendons, the specific weight limitation will be a proportional to the ratio of linear dimensions of such anchor to corresponding dimensions on the above example anchor for 0.500 inch nominal OD tendons. Assuming that all anchor dimensions are approximately linearly scaled in relation to the intended OD of the tendon, the specific weight limitation can be calculated by the following expression:

$$W = 0.10 \times \left(\frac{d_t}{0.5}\right) \tag{1}$$

wherein W represents the approximate limit of the specific weight in pounds per square inch of load bearing area, and $d_t$ represents the nominal, or load bearing, diameter (in inches) of the tendon for which the particular anchor is sized.

Figure 9:
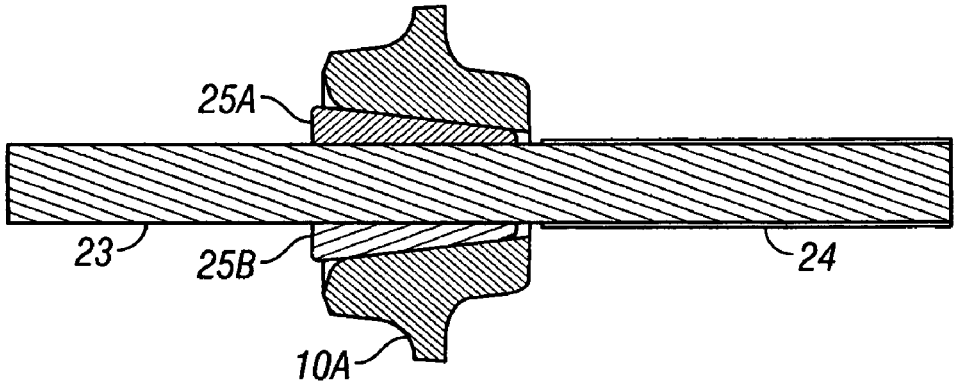
FIG. 9 shows a cut away view of an assembled sheathed tendon, anchor wedges and an anchor according to one embodiment of the invention.

FIG. 9 shows an anchor according to the invention assembled to a tendon 23 having a sheath 24 on its exterior surface. The tendon 23 is locked into the anchor 10A by wedge segments 25A, 25B which may be of any type known in the art.

Figure 10:
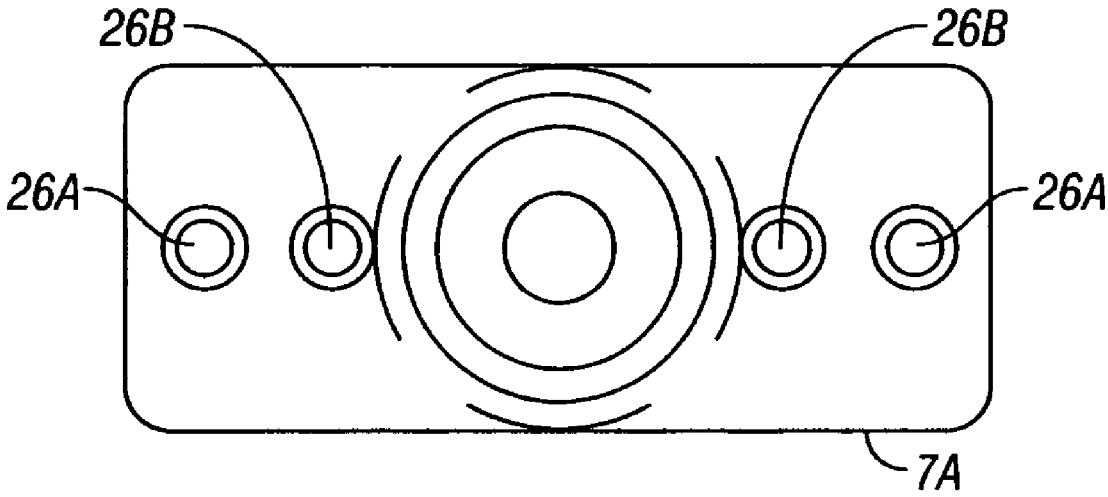
FIG. 10 shows another embodiment of an anchor having four mounting holes in the metal structure.

FIG. 10 shows another particular embodiment which includes four accessory/mounting holes 26A, 26B in the metal structure 7A. Prior art anchors typically included only two such holes, generally located as shown at 26A in the metal structure 7A. The extra holes 26B may be used to affix the anchor to a concrete form and/or to mount accessories, such as plastic encapsulating elements (not shown in the Figures).

Another possible advantage of an anchor made according to the invention is that having a larger minimum internal diameter of the wedge receiving bore may reduce the incidence of pinching the nose (or small) end of the wedge into the tendon. Pinching at the nose end of the wedge is believed to cause tensile failure of tendons in a number of circumstances. Still another advantage of an anchor made according to the invention is improved quality of casting procedures for the anchor base.

The foregoing aspect of the invention in which the specific weight of the anchor is at most a particularly defined amount is also intended, in particular embodiments, that the anchor have at least a minimum amount of load bearing area. A minimum load bearing area is preferred such that the anchor can be safely used in post-tension reinforcement. It can be inferred from the description relating to equation (1) that merely reducing the load bearing area of the anchor, such as by reducing the lateral dimensions of the basal structure 12A, would, in fact, result in a reduction of the specific weight. However, such reduced area structures may be unsuitable for post-tension reinforcement of concrete structures. An analysis of why it is necessary to have a certain minimum load bearing area in an anchor, and how to determine minimum useful load bearing area is described in, Post-Tensioning Manual, Post-Tensioning institute, 1717 W. Northern Ave., Phoenix, Ariz. 85201, Fifth Edition, Second Printing (1995). More specifically, because the load bearing area of the anchor is typically smaller than the cross sectional area of the reinforced concrete structure, tensile stress applied to the concrete by the anchor is necessarily unevenly distributed at the ends of the concrete structure. Transferred tensile force from the stretched tendon is concentrated at the load bearing area of the anchor at the axial ends of the concrete, and gradually distributes over the entire cross-section of the concrete at some distance from the axial ends. Such transferred force distribution necessarily means that the force includes some component that is transverse to the axis of the tendon and concrete between the axial ends of the concrete and where the full cross-section distribution occurs. If the load bearing area of the anchor is too small, the transverse forces may cause internal tension in the concrete which in some places may exceed the tensile strength of the concrete (known in the art as "bursting stresses"). Another reason for needing at least a certain amount of load bearing area on the anchor is development of localized tensile stresses at the axial ends of the concrete structure, called "spalling stresses." If there is insufficient load bearing area in the anchor, the spalling stresses may exceed the tensile stress of the concrete, leading to failure at the axial ends thereof.

In the *Post-Tensioning Manual*, see pp. 208-236, Section 3.1, *Guide Specifications for Post-Tensioning Materials*, and more particularly, Section 3.1.7, Bearing Stresses, in which it is stated that the average bearing stresses on the concrete created by the anchorage plates shall not exceed the values allowed by the following equations:

$$\text{at service load: } f_{cp}=0.6f_c\sqrt{A_b'/A_b} \quad (2)$$

but not greater than 1.25 $f'_c$ $$\text{at transfer load: } f_{ci}=0.6f_c\sqrt{A_b'/A_b-0.2} \quad (3)$$

but not greater than 1.25 $f'_c$ where $f_{cp}$ represents the allowable compressive concrete stress, $f'_c$ represents the compressive strength of the concrete, $f'_{ci}$ represents the compressive strength of the concrete at the time of initial stressing, $A'_b$ represents the maximum area of the concrete structure that is concentric with, and geometrically similar to the geometric area of the anchorage, and $A_b$ represents the bearing area of the anchorage. The dimensions and area of a post-tension anchor are further defined for their intended purpose in, *Acceptance Standards for Post-Tensioning Systems*, Post-Tensioning Institute, 1717 W. Northern Ave., Phoenix, Ariz. 85201 (1999):

$$a_x=b_x+2e_x\leqq 2b_x$$

$$a_y=b_y+2e_y\leqq 2b_y$$

$$0.25\leqq e_x/e_y\leqq 4 \quad (4)$$

in which $a_x$, $a_y$, represent the long transverse (to the longitudinal axis) dimension and the short transverse dimension, respectively, of the concrete structure, $b_x$, and $b_y$, respectively, represent the long lateral (or transverse) dimension and the short lateral (or transverse) dimension of the anchor, and $e_x$, $e_y$, represent, respectively, the distance from the edge of the anchor to the edge of the concrete structure along the long and short dimensions of the structure. Collectively, the foregoing limitations in load bearing area of the anchor and cross section of the concrete structure are referred to as "post-tension acceptance standards." In a preferred embodiment of an anchor made according to the present aspect of the invention, the specific weight of the anchor is at most the amount determined by equation (1) and such anchor meets the foregoing post-tension acceptance standards.

It should be clearly understood that any or all of the foregoing aspects of an anchor made according to the invention are applicable to a composite structure in which more than one wedge receiving bore is included, such composite structures being used to anchor a plurality of reinforcing tendons.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. An anchor for a post tensioned concrete reinforcement, comprising:

an anchor base having a substantially flat metal structure with at least one wedge receiving bore therein, the wedge receiving bore extending from the metal structure in at least one direction transverse to a load transfer surface of the structure, supporting ribs extending from an exterior of the wedge receiving bore to a surface of the metal structure, the wedge receiving bore being tapered in diameter at a single selected taper angle, the taper extending substantially continuously from a first end of the bore to a second end of the bore, an axial length of the wedge receiving bore selected so that a minimum internal diameter of the wedge receiving bore is at least one half the axial length.

2. The anchor of claim 1 wherein a basal surface of the anchor base is disposed approximately at a longitudinal center of the wedge receiving bore.

3. The anchor of claim 1 wherein the single selected taper angle is approximately seven degrees.

4. The anchor of claim 1 wherein the axial length is at most 1.3 times a maximum internal diameter of the wedge receiving bore.

5. The anchor of claim 1 further comprising reinforcing ribs extending laterally outward from the wedge receiving bore, a height of reinforcing ribs at most 0.35 times a maximum internal diameter of the wedge receiving bore.

6. The anchor of claim 1 wherein the anchor base has a specific weight of at most 0.10 pounds per square inch.

7. The system of claim 1 wherein the anchor base has a specific weight of at most $$W = 0.10\times\left(\frac{d_t}{0.5}\right)$$

wherein W represents the approximate limit of the specific weight in pounds per square inch of load bearing area, and $d_t$ represents a nominal diameter of the tendon for which the anchor base is sized.

8. The anchor of claim 7 wherein the load bearing area is at least an amount adapted to conform to post-tension acceptance standards.

9. The anchor of claim 1 further comprising at least one reinforcing rib extending from the wedge receiving bore toward a lateral edge of the anchor base, the at least one rib terminating at a position between 0.03 to 0.1 times a length of the anchor base.

10. The anchor of claim 1 further comprising at least four mounting holes in the anchor base.

11. A post tension concrete anchor system, comprising:

a tendon having a sheath therearound;

an anchor base having a substantially flat metal structure with at least one wedge receiving bore therein, the wedge receiving bore extending from the metal structure in at least one direction transverse to a load transfer surface of the structure, supporting ribs extending from an exterior of the wedge receiving bore to a surface of the metal structure, the wedge receiving bore being tapered in diameter at a single selected taper angle, the taper extending substantially continuously from a first end of the bore to a second end of the bore, an axial length of the wedge receiving bore selected so that a minimum internal diameter of the wedge receiving bore is at least one half the axial length; and wedges disposed in mating relationship between an exterior surface of the tendon and the wedge receiving bore.

12. The system of claim 11 wherein a load bearing basal surface of the anchor base is disposed substantially at a midpoint of the axial length of the wedge receiving bore.

13. The system of claim 11 wherein the single selected taper angle is substantially equal to seven degrees.

14. The system of claim 11 wherein the axial length is at most 1.3 times a maximum internal diameter of the wedge receiving bore.

15. The system of claim 11 further comprising reinforcing ribs extending laterally outward from the wedge receiving bore, a height of the reinforcing ribs at most 0.35 times a maximum internal diameter of the wedge receiving bore.

16. The system of claim 11 wherein the anchor base has a specific weight of at most 0.10 pounds per square inch.

17. The system of claim 11 wherein the anchor base has a specific weight of at most $$W = 0.10 \times \left(\frac{d_t}{0.5}\right)$$

wherein W represents the approximate limit of the specific weight in pounds per square inch of load bearing area, and $d_t$ represents a nominal diameter of the tendon for which the anchor base is sized.

18. The system of claim 17 wherein the load bearing area is at least an amount adapted to conform to post-tension acceptance standards.

19. The system of claim 11 further comprising at least one rib extending from an outer surface of the wedge receiving bore toward a lateral edge of the anchor base, the at least one rib terminating at a position between 0.03 to 0.1 times a length of the anchor base.

20. The system of claim 11 wherein the anchor base includes at least four mounting holes.

21. A post tensioned concrete reinforcement anchor, comprising:

an anchor base having at least one wedge receiving bore therein and reinforcing ribs extending between an upper surface of the anchor base and an exterior of the receiving bore, a longitudinal length of the wedge receiving bore, a position of a midpoint of an axial length of the wedge receiving bore with respect to a load bearing basal surface of the anchor base, and a lateral extension and height of the ribs selected such that a specific weight of the anchor base is at most 0.1 pounds per square inch of load bearing area, wherein the wedge receiving bore is tapered in diameter at a single selected taper angle, the taper extending substantially continuously from a first end of the bore to a second end of the bore, an axial length of the wedge receiving bore selected so that a minimum internal diameter of the wedge receiving bore is at least one half of the axial length.

22. The anchor of claim 21 wherein the anchor base has a specific weight of at most $$W = 0.10 \times \left(\frac{d_t}{0.5}\right)$$

wherein W represents the approximate limit of the specific weight in pounds per square inch of load bearing area, and $d_t$ represents a nominal diameter of the tendon for which the anchor base is sized.

23. The anchor of claim 22 wherein the load bearing area of the anchor is selected to be at least an amount adapted to conform to post-tension acceptance standards.

24. The anchor of claim 21 wherein a load bearing basal surface of the anchor base is disposed substantially at a midpoint of the axial length of the wedge receiving bore.

25. The anchor of claim 21 wherein the single selected taper angle is seven degrees.

26. The anchor of claim 21 wherein the axial length is at most 1.3 times a maximum internal diameter of the wedge receiving bore.

27. The anchor of claim 21 wherein a height of reinforcing ribs is at most 0.35 times a maximum internal diameter of the wedge receiving bore.

28. The anchor of claim 21 further comprising at least one rib extending from an outer surface of the wedge receiving bore toward a lateral edge of the anchor base, the at least one rib terminating at a position between 0.03 to 0.1 times a longest transverse dimension of the anchor base.

29. The anchor of claim 21 wherein the anchor base includes at least four mounting holes.

30. A post tensioned concrete reinforcement anchor, comprising:

an anchor base having at least one wedge receiving bore therein, a load bearing basal surface of the anchor base disposed substantially in a same plane as a midpoint of an axial length of the wedge receiving bore, the load bearing surface being that surface wherein tensile load from a tendon is transferred to a concrete structure, wherein the wedge receiving bore is tapered in diameter at a single selected taper angle, the taper extending substantially continuously from a first end of the bore to a second end of the bore, an axial length of the wedge receiving bore selected so that a minimum internal diameter of the wedge receiving bore is at least one-half the axial length.

31. The anchor of claim 30 wherein the single selected taper angle is substantially equal to seven degrees.

32. The anchor of claim 30 wherein the axial length is at most 1.3 times a maximum internal diameter of the wedge receiving bore.

33. The anchor of claim 30 wherein a height of reinforcing ribs is at most 0.35 times a maximum internal diameter of the wedge receiving bore.

34. The anchor of claim 30 wherein the anchor base has a specific weight of at most 0.10 pounds per square inch.

35. The anchor of claim 30 wherein the anchor base has a specific weight of at most $$W = 0.10 \times \left(\frac{d_t}{0.5}\right)$$

wherein W represents the approximate limit of the specific weight in pounds per square inch of load bearing area, and $d_t$ represents a nominal diameter of the tendon for which the anchor base is sized.

36. The anchor of claim 35 wherein the load bearing area of the anchor is selected to be at least an amount adapted to conform to post-tension acceptance standards.

37. The anchor of claim 30 further comprising at least one rib extending from an outer surface of the wedge receiving bore toward a lateral edge of the anchor base, the at least one rib terminating at a position between 0.03 to 0.1 times a longest transverse dimension of the anchor base.

38. The anchor of claim 30 wherein the anchor base includes at least four mounting holes.

* * * * *